US009048596B2

(12) United States Patent
Cavallieri et al.

(10) Patent No.: US 9,048,596 B2
(45) Date of Patent: Jun. 2, 2015

(54) CONNECTOR WITH RESILIENT LATCHES TO ACCOMMODATE MOUNTING TO CURVED OR ARCUATE SURFACES

(71) Applicant: TYCO ELECTRONICS BRASIL LTDA., Sao Paulo (BR)

(72) Inventors: Amadeu Luiz Fazani Cavallieri, Campinas-SP (BR); Fabio Fortunato Christiano, Itapira-SP (BR); Jose Roberto Goldschmidt, Campinas-SP (BR)

(73) Assignee: TYCO ELECTRONICS BRASIL LTDA, Sao Brazil (BR)

( * ) Notice: Subject to any disclaimer, the term of this patent is extended or adjusted under 35 U.S.C. 154(b) by 182 days.

(21) Appl. No.: 13/910,750

(22) Filed: Jun. 5, 2013

(65) Prior Publication Data

US 2014/0363997 A1 Dec. 11, 2014

(51) Int. Cl.

| | |
|---|---|
| ***H01R 13/625*** | (2006.01) |
| ***H01R 4/50*** | (2006.01) |
| ***H01R 43/26*** | (2006.01) |
| ***H01R 13/73*** | (2006.01) |

(52) U.S. Cl.
CPC ..... *H01R 13/73* (2013.01); *H01R 43/26* (2013.01)

(58) Field of Classification Search
CPC ..... H01R 43/26
USPC ..... 439/345
See application file for complete search history.

(56) References Cited

U.S. PATENT DOCUMENTS 4,427,879 A 1/1984 Becher et al.
2013/0316599 A1* 11/2013 Goldschmidt et al. ..... 439/782

* cited by examiner

*Primary Examiner* — Javaid Nasri

(57) ABSTRACT

An electrical connector and method for mounting to mating member with an arcuate cylindrical member. The electrical connector includes a housing and a mounting member extending from the housing. The mounting member has latching members and a mating member receiving section. The mating member receiving section has an arcuate configuration which cooperates with the arcuate cylindrical member to maintain the electrical connector on the arcuate cylindrical member. The latching members have latching arms, with each latching arm having an arcuate configuration which cooperates with a surface of the mating member to prevent unwanted rotation of the electrical connector relative to the mating member.

20 Claims, 6 Drawing Sheets

CONNECTOR WITH RESILIENT LATCHES TO ACCOMMODATE MOUNTING TO CURVED OR ARCUATE SURFACES

FIELD OF THE INVENTION

The present invention is directed to a connector and method for mounting a connector to curved or arcuate surfaces. In particular, the invention is directed to a connector with resilient latches which cooperate with a curved or arcuate cylinder or pipe to properly mount the connector to the curved or arcuate cylinder.

BACKGROUND OF THE INVENTION

As more electronics are being used in devices or equipment, such as automobiles, more connectors are required to secure the electrical connections. However, as space is often at a premium, finding space to mount connectors in traditional spaces and using traditional techniques has become difficult.

In order to accommodate the need for additional electronics and additional connectors, connectors must be provided in areas not traditionally used to mount the electrical connectors. In one example, due to the electronics needed for seat belts in automobiles, connectors are required to be placed in the door columns of the automobile chassis. In such location, traditional mounting techniques of connectors are not sufficient, as there are no flat or straight surfaces on which the connector can be mounted.

It is, therefore, an object of the present invention to provide a mounting member for a connector which can be mounted and secured to curved or arcuate surfaces.

SUMMARY OF THE INVENTION

A mounting member which secures a connector in place on a mating member, thereby preventing unwanted rotation and movement of the connector relative to the member. The mounting member allows the connector to be mounted in areas in which space is at a premium or where nontraditional mounting surfaces are provided. By providing a mounting member which can be mounted to a curved or arcuate cylindrical member or the like, the connector may be mounted in areas which have hereto before been unavailable for connector mounting.

An embodiment is directed to an electrical connector for mounting to mating member with an arcuate cylindrical member. The electrical connector includes a housing and a mounting member extending from the housing. The mounting member has latching members and a mating member receiving section. The mating member receiving section has an arcuate configuration which cooperates with the arcuate cylindrical member to maintain the electrical connector on the arcuate cylindrical member. The latching members have latching arms, with each latching arm having an arcuate configuration which cooperates with the a surface of the mating member to prevent unwanted rotation of the electrical connector relative to the mating member.

The configuration of the latching arms allows the resilient latching arms to resiliently deform during the assembly of the connector to the mating member. The latching arm provides a snap fit when the mounting member of the connector is fully mated with the mating member.

An embodiment is directed to a mounting member for use with a connector. The mounting member includes a latching member, a stabilization member and a mating member receiving section. The mating member receiving section has an arcuate configuration which cooperates with a mating arcuate cylindrical member of a mating connector to maintain the connector on the arcuate cylindrical member. The latching member has a latching arm, the latching arm has an arcuate configuration which cooperates with the a surface of the mating member to prevent unwanted rotation of the connector relative to the mating member. The stabilization member has an arcuate configuration which cooperates with the mating arcuate cylindrical member of the mating connector to prevent lateral movement of the connector relative to the arcuate cylindrical member.

An embodiment is directed to a method of inserting a connector on an arcuate cylindrical mating member, the method comprising: moving the connector into position proximate the mating member; resiliently deflecting a free end of a receiving section, allowing a projection of the receiving section to maintained the receiving section on the mating member; rotating the connector on the mating member, causing a shoulder of a resilient latching arm to cooperate with a wall of the mating member; continuing rotation of the connector until a stop surfaces of the latching arm is positioned proximate to or in engagement with the wall of the mating member, thereby allowing the latching arm to be returned toward its unstressed position, whereby the cooperation of the shoulder and the stop surface with the wall of the mating member prevent further unwanted rotation of the connector relative to the mating member.

The method may include providing a stabilization member, the stabilization member engaging the mating member to prevent lateral movement of the connector relative to the mating member.

The stabilization member ensures that the connector is maintained in proper position, thereby facilitating the positioning of the connector in spaces with tight tolerances. Additionally, as the connector is maintained in position, the movement of the connector is minimized, thereby reducing or eliminating noise associated with the movement of the connector.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
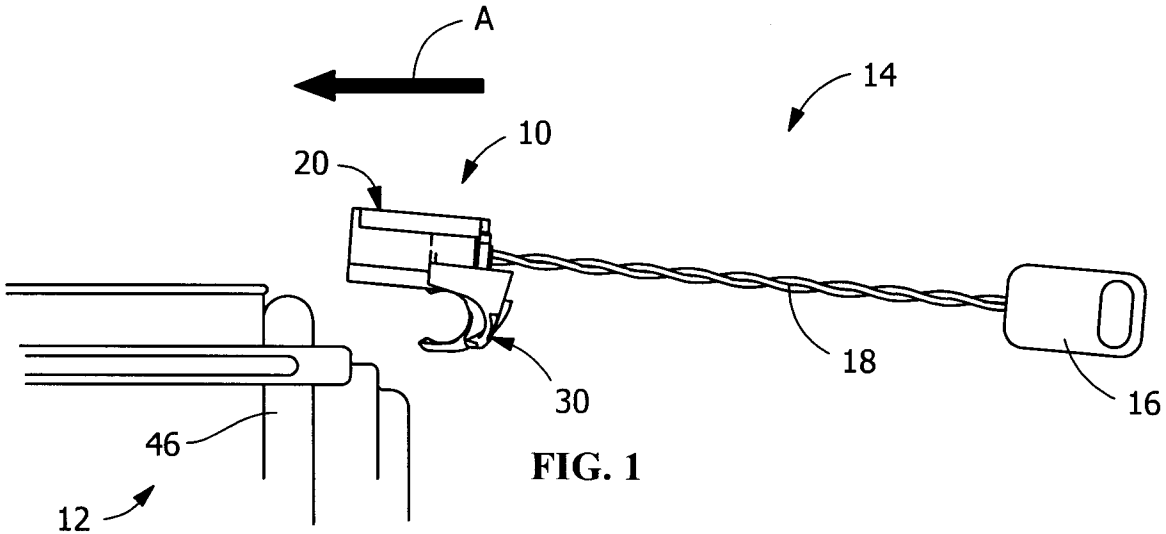
FIG. 1 is a side view of an illustrative embodiment of an electrical connector prior to be moved into position on a mating member.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

The present invention is directed to an electrical connector 10 having a terminal receiving housing 20 and a mounting member 30 which extends from the housing 20. The mounting member 30 secures the connector 10 in place on a mating member 12, thereby preventing unwanted rotation and movement of the connector 10 relative to the member 12. In the embodiment shown in FIGS. 1 through 3, the electrical connector is part of an assembly 14 which has a second connector 16 provided at the end of the twisted pairs of wires 18. However, the electrical connector 10 and the invention claimed herein can be used with many different assemblies and many different connectors.

The terminal receiving housing 20 has terminal receiving passages 22 which extend therethrough. Terminals (not shown) are provided in the terminal receiving passages 22. The terminals are mounted in the terminal receiving passages 22 in a manner know in the art. In the embodiment shown, the terminal receiving housing is an AMPLIMITE® connector made by TE Connectivity which houses AMPLIMITE® terminals made by TE Connectivity. However, the invention is not limited to the type of connector and terminals shown. The mounting member 30 may be used on many types of connectors utilizing many different types of terminals. As the terminal receiving housing 20 and the terminals are known in the prior art, a further explanation of the terminal receiving housing 20 and the terminals will not be provided.

The mounting member 30 extends from the housing 20. In the embodiment illustrated, the mounting member 30 and the housing 20 are separate pieces which are joined together by walls, latches or the like. However, other methods of attaching the mounting member 30 to the housing can be used. The use of a two piece construction illustrated allows the molding member 30 and the housing 20 to be molded in mold dies which do not require slide tooling.

Figure 5:
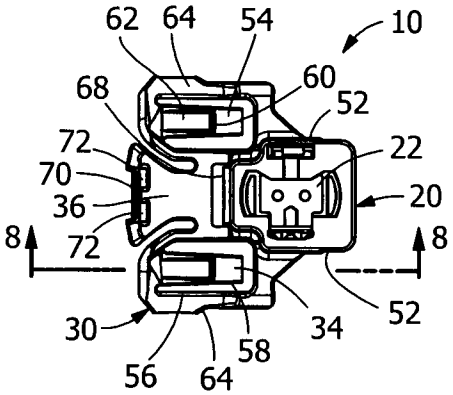
FIG. 5 is a top view of the illustrative embodiment of the electrical connector of FIG. 4.
Figure 6:
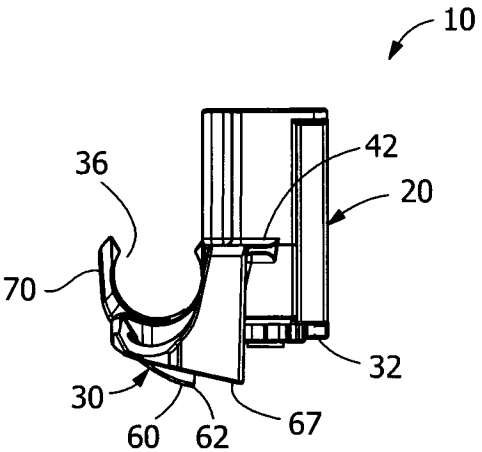
FIG. 6 is a side view of the illustrative embodiment of the electrical connector of FIG. 4.
Figure 4:
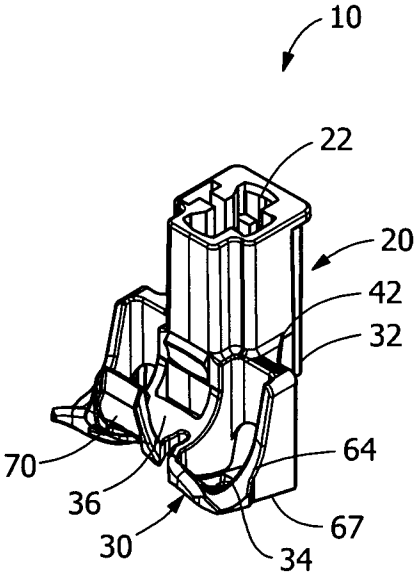
FIG. 4 is a perspective view of the illustrative embodiment of the electrical connector of FIG. 1.

As best shown in FIGS. 4 through 6, mounting member 30 has a housing receiving portion 32, a pair of latching members 34, and a mating member receiving section 36. In the embodiment shown, the pair of resilient latching members 34 extends from the mating member receiving section 36 toward housing 20. The mating member receiving section 36 extends from the housing receiving portion 32 and extends between the resilient latching members 34.

Figure 7:
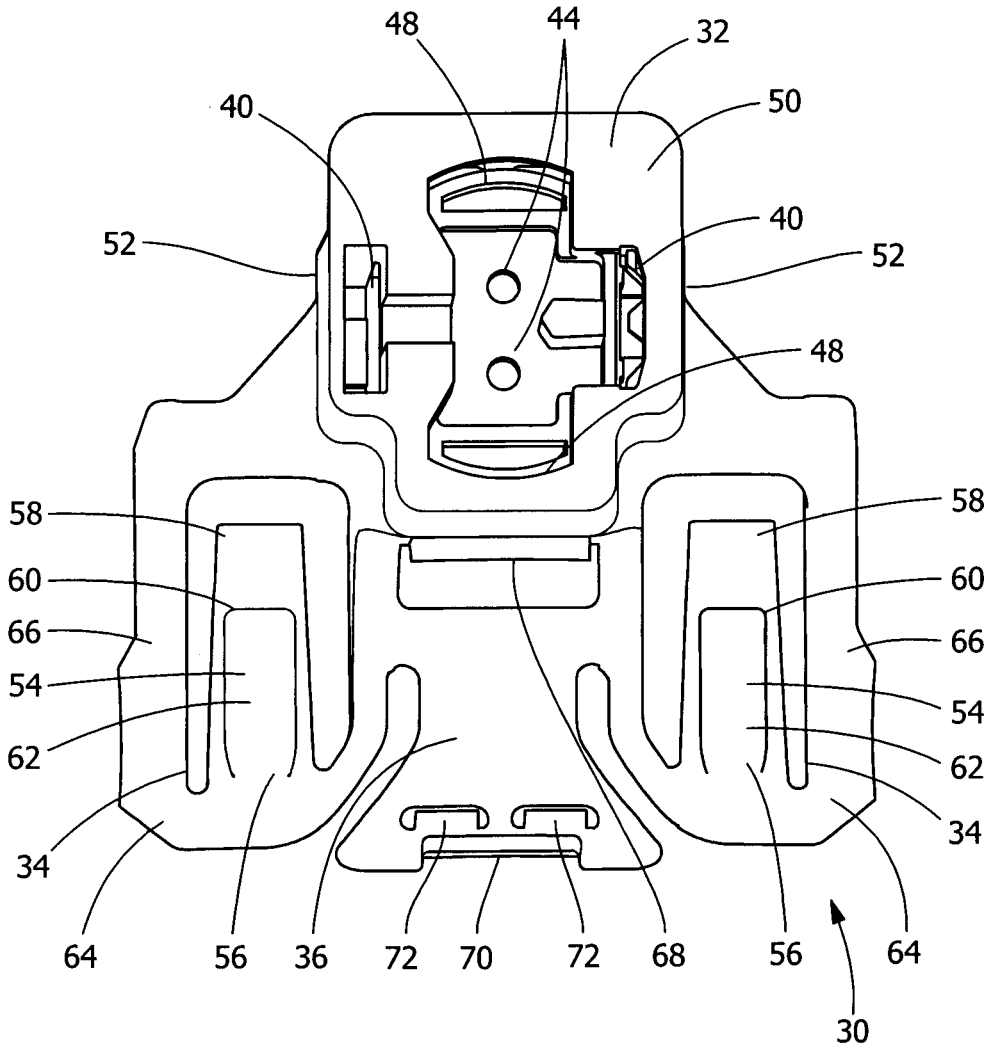
FIG. 7 is a top view of an illustrative mounting member of the electrical connector of FIG. 4.

As best shown in FIG. 7, the housing receiving portion 32 has openings 40 which are dimensioned to receive latching arms 42 (FIG. 6) of the terminal receiving housing 20 therein. The cooperation of the latching arms 42 and the openings 40 prevents the lateral movement of the housing 20 relative to the mounting member 30 and secures the housing 20 to the mounting member 30. Wire receiving openings 44 extend through the housing receiving portion 32, allowing wires 18 which are terminated to the terminals (not shown) to extend therethrough. Positioning projections 48 are provided on the housing receiving portion 32. The positioning projections 48 extend outward from a mating surface 50 of the housing receiving portion 32 to engage the housing 20, thereby facilitating the proper positioning of the housing 20 on the housing receiving portion 32 of the mounting member 30.

Figure 8:
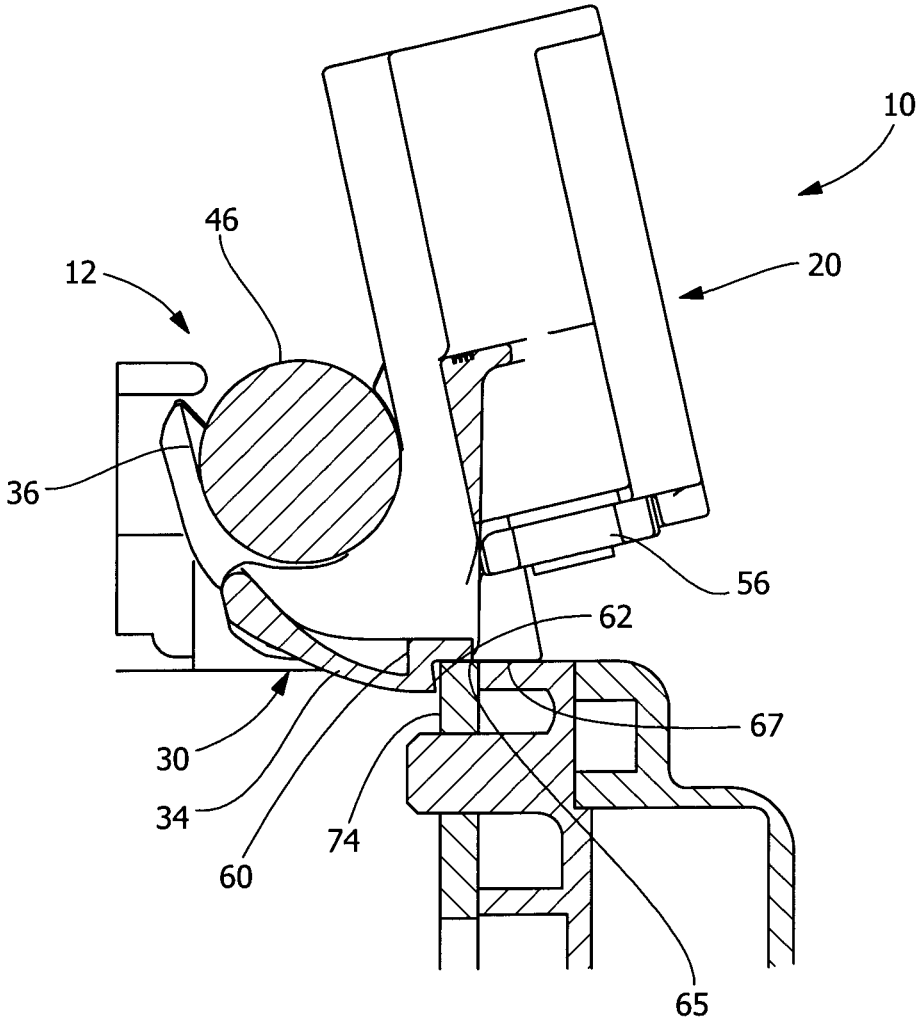
FIG. 8 is a fragmentary cross-sectional view of the electrical connector taken along line 8-8 of FIG. 5, showing the electrical connector fully inserted and retained on the mating member.
Figure 9:
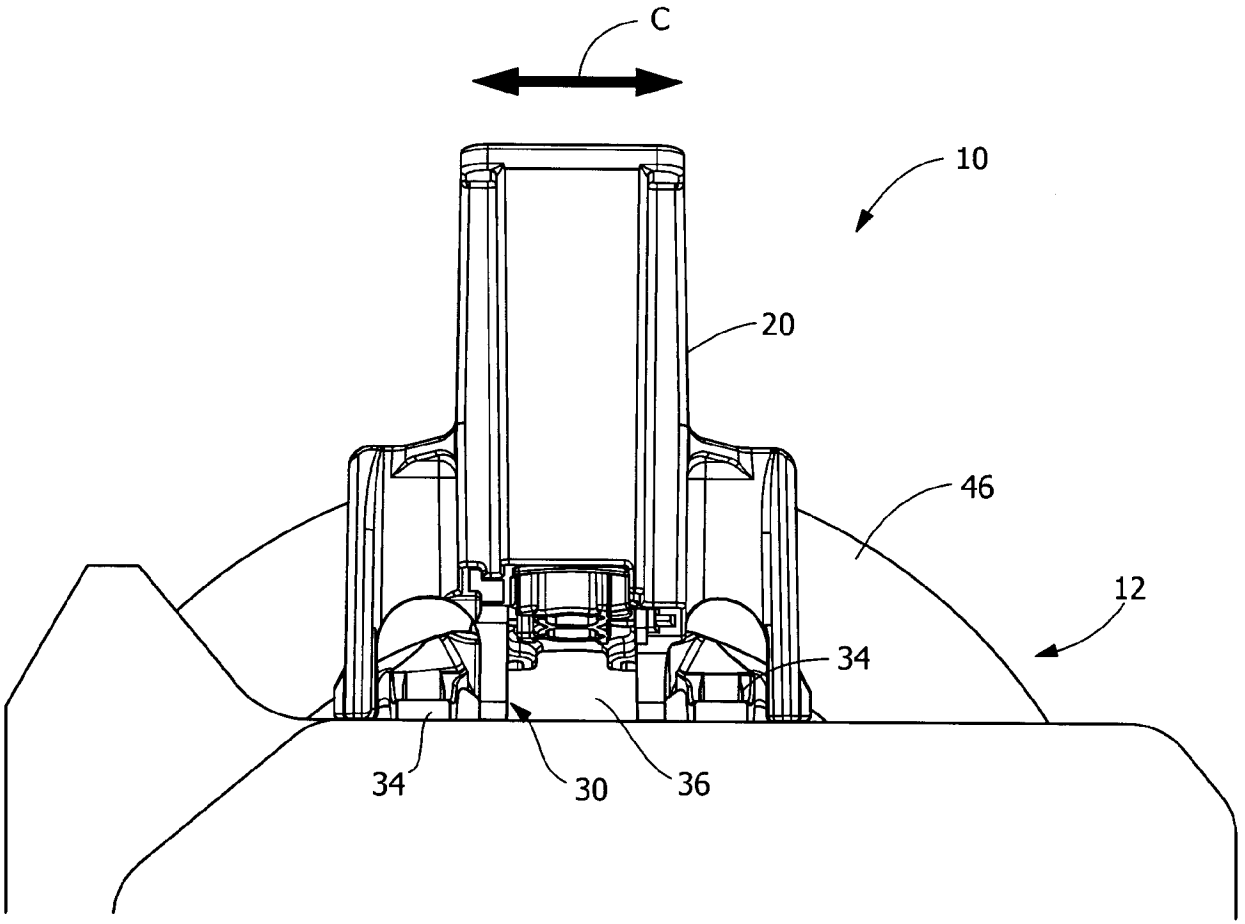
FIG. 9 is a fragmentary front view of the electrical connector mated to the mating member shown in FIG. 8.

As best shown in FIGS. 5 through 8, latching members 34 extend from the housing receiving portion 32 and have a curved or arcuate profile, so that the mounting member 30 and the attached housing 20 can be secured to the mating member 12, which includes, but is not limited to a curved or arcuate cylindrical member or pipe 46, as shown in FIGS. 8 and 9.

Referring to FIG. 7, each latching member 34 has a resilient latch 54, which in the embodiment shown is a latching arm 54 formed of, for example, a preset, semi rigid thermoplastic material. The latching arm 54 has a fixed end 56 which is attached to the latching member 34 and a free end 58. In the embodiment shown, the longitudinal axis of each of the latching arm 54 extends essentially parallel to the side walls 52. A locking shoulder 60 and an inclined surface 62 are provided on an outside surface of the latching arm 54 (as best shown in FIGS. 8 and 9). The locking shoulder 60 is provided at the end of the inclined or bearing surface 62 of each latching arm 54. The inclined surface 62 is inclined from proximate to the fixed end 56 to the shoulder 60. A stop surface 67 (as shown in FIGS. 6 and 8) extends from proximate the locking shoulder 60 toward the fixed end 56. The latching arm 54 is curved or arcuate to have a curved or arcuate profile similar to that of the latching member 34. The radiuses of the curved or arcuate surfaces of the latching arms 54 and the latching members 34 are dimensioned to allow the curved or arcuate cylindrical member 46 of the mating member 12 to be received therein. The inclined surfaces 54 are configured to resiliently bear against a wall 65 (FIG. 8) of the mating member 12 as the connector 10 is rotated during mounting of the connector 10 on the mating member 12, as will be more fully described.

Referring to FIGS. 5 and 7, each latching member 34 has at least one stabilization member 64. In the embodiment shown, the stabilization member 64 is spaced from the resilient latching arm 54. The longitudinal axis of the stabilization arms 36 is essentially parallel to the longitudinal axis of the resilient latching arm 54. An end of the stabilization member 64 is fixed to a respective side wall 52 of the housing receiving portion 32. The stabilization member 64 is curved or arcuate to have a curved or arcuate profile. The radius of the curved or arcuate surfaces of the stabilization members 64 is dimensioned to allow the curved or arcuate cylindrical member 46 of the mating member 12 to be received therein. A bearing surface 66 is provided on each stabilization member 64. The bearing surface 66 engages the mating member 12 to prevent lateral movement of the connector 10 relative to the mating member 12, as will be more fully described.

As best shown in FIGS. 4 through 7, the mating member receiving section 36 extends from the housing receiving portion 32 and extends between the resilient latching members 34. The receiving section 36 has a fixed end 68 which is attached to the housing receiving portion 32 and a free end 70. The receiving section 36 is curved or arcuate to have a curved or arcuate profile. The radius of the curved or arcuate surfaces of the receiving section 36 is dimensioned to allow the curved or arcuate cylindrical member 46 of the mating member 12 to be received therein. Projections 72 are provided proximate the free end 70 of the receiving section 36. The projections 72 are configured to bear against the mating member 12 as the connector 10 is inserted on the mating member 12. Once fully inserted onto the mating member, the projections 72 secure the receiving section 36 on the mating member 12, as will be more fully described.

Figure 2:
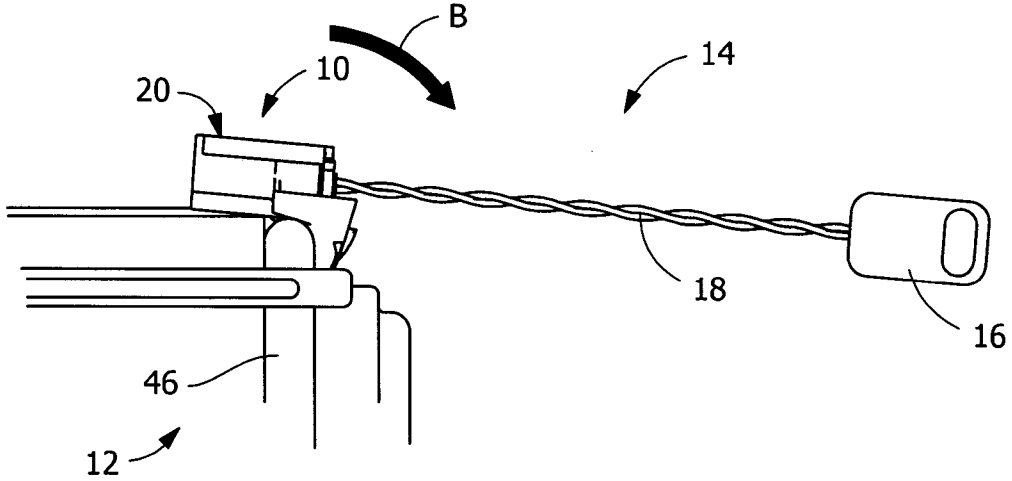
FIG. 2 is a side view of the electrical connector of FIG. 1 showing the electrical connector moved into an initial position with the mating member.
Figure 3:
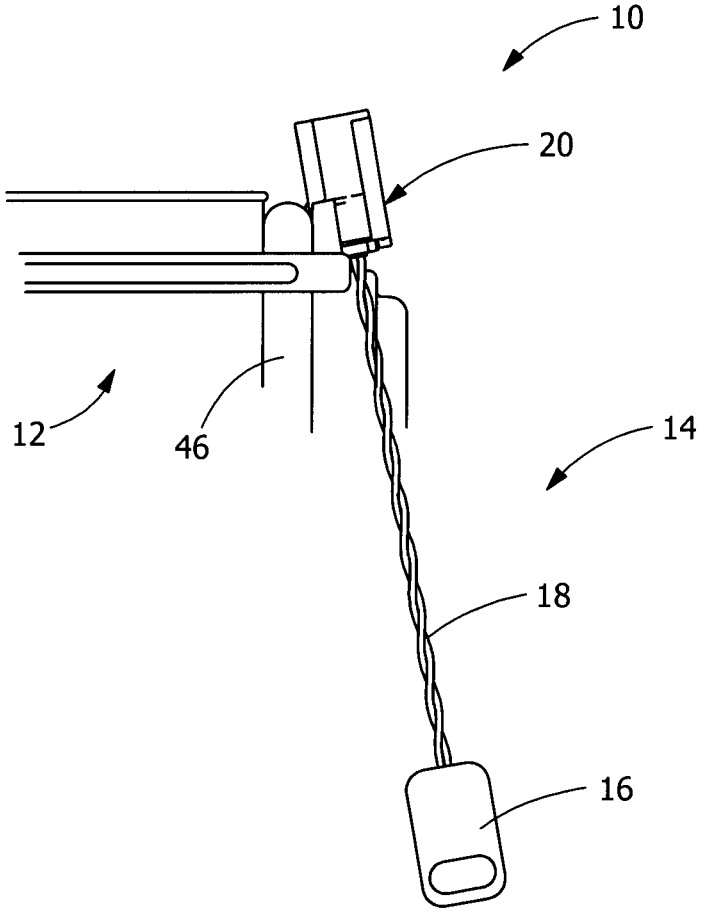
FIG. 3 is a side view of the electrical connector of FIG. 1 showing the electrical connector moved into a final, secured position on the mating member.

Referring to FIGS. 1 through 3, the insertion of the connector 10 onto the mating member 12 is illustrated. As shown in FIG. 1, the connector 10 is moved into position proximate the mating member 12. The connector is moved in the direction of arrow A to allow the latching member 34 to move into engagement with the curved or arcuate cylindrical member of the mating member 12. As this occurs, the projections 72 engage the mating member 12, causing the free end 70 to resiliently deflect. As insertion continues, the projections 72 are moved passed the curved or arcuate cylindrical member 46 of the mating member 12, thereby allowing the free end 70 and the projections 72 to be returned toward an unstressed position. This resilient or snap-action allows the curved or arcuate cylindrical member 46 of the mating member 12 to be maintained in the receiving section 36, which in turn allows the connector 10 to be movably mounted on the mating member 12.

With the connector 10 properly inserted onto the mating member 12, the connector 10 is rotated, as indicated by arrow B of FIG. 2, to the fully installed position, as represented in FIGS. 3. As this occurs, the inclined surfaces 62 of the latching arms 54 cooperate with the wall 65 of the mating member 12, causing the latching arms 54 to be resiliently deformed away from the wall 65 of the mating member 12. This resilient deformation continues until the inclined surface 62 is moved beyond the wall 65, as shown in FIG. 8. In this position, the latching arms 54 are returned toward their unstressed position, thereby allowing the shoulders 60 to be positioned proximate to or in engagement with an end 74 of the wall 65. In this position, the stop surfaces 67 of the latching arms 54 are positioned proximate to or in engagement with the wall 65. The stop surfaces 67 also provide a positive stop for the rotation of the connector 10, as the stop surface 67 engages the wall 65 to prevent continued rotation. In this fully installed position, the cooperation of the shoulder 60 with the end 74 of wall 65 and the cooperation of the stop surface 67 with the wall 65 prevent further unwanted rotation of the connector 10 relative to the mating member 12.

Stated differently, resilient latching arms 54 are dimensioned so that when the connector 10 is rotated, the shoulder 60 of each resilient latching arm 54 moves past the surface 74 of the wall 65 of the mating member or device 12, allowing the resilient latching arm 54 to move toward an unstressed position, causing the shoulder 60 of the resilient latching arm 54 to engage or be positioned proximate to the surface 74 of the wall 65 to lock the connector 10 in position and prevent further unwanted rotation.

In this position, the stabilization members 64 cooperate with the curved or arcuate cylindrical member of the mating member 12 to prevent lateral or translation movement of the connector 10 in the direction indicated by arrow C of FIG. 9. The stabilization members 64 are dimensioned such that one stabilization member 64 will engage the curved or arcuate cylindrical member on one side of the connector 10 and another stabilization member 64 will engage the curved or arcuate cylindrical member on the other side of the connector 10. Consequently, if an attempt is made to move the connector in the lateral direction, a respective bearing surface 66 of a respective stabilization member 64 will engage the curved or arcuate cylindrical member, causing the stabilization member 64 to bind with the curved or arcuate cylindrical member, preventing the connector 10 from moving in the lateral direction. In addition, the bearing surfaces 66 frictionally engage with the curved or arcuate cylindrical member of the mating member 12, thereby inhibiting movement of the connector 10 in the lateral direction.

The mounting member 30 allows the connector 10 to be mounted in areas in which space is at a premium or where nontraditional mounting surfaces are available. By providing a mounting member which can be mounted to a curved or arcuate cylindrical member or the like, the connector may be mounted in areas which have hereto before been unavailable for connector mounting. This is beneficial in many areas, such as, but not limited to in the column of a car.

The stabilization member helps to ensure that the connector is maintained in proper position, thereby facilitating the positioning of the connector in spaces with tight tolerances. Additionally, as the connector is maintained in position, the movement of the connector is minimized, thereby reducing or eliminating noise associated with the movement of the connector.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical connector for mounting to mating member with an arcuate cylindrical member, the electrical connector comprising:

a housing;

a mounting member extending from the housing, the mounting member having latching members and a mating member receiving section;

the mating member receiving section having an arcuate configuration which cooperates with the arcuate cylindrical member to maintain the electrical connector on the arcuate cylindrical member; and the latching members having latching arms, each latching arm having an arcuate configuration which cooperates with a surface of the mating member to prevent unwanted rotation of the electrical connector relative to the mating member.

2. The electrical connector as recited in claim 1, wherein each latching arm has a fixed end which is attached to the latching member and a free end, the latching arm being resiliently deformed as the electrical connector is inserted on to the mating member.

3. The electrical connector as recited in claim 2, wherein each latching arm has a locking shoulder and an inclined surface, the locking shoulder is at the end of the inclined surface, the inclined surface is inclined from proximate the fixed end to the shoulder, the inclined surface is configured to resiliently bear against a wall of the mating member as the electrical connector is rotated during mounting of the electrical connector to the mating member.

4. The electrical connector as recited in claim 3, wherein a stop surface extends from proximate the locking shoulder toward the free end, the stop surface cooperates with the wall of the mating member, whereby the cooperation of the locking shoulder and the stop surface with the wall of the mating member prevents unwanted rotation of the electrical connector relative to the mating member.

5. The electrical connector as recited in claim 1, wherein the mating member receiving section extends between the latching members, the mating member receiving section has a fixed end which is attached to the latching members and a free end.

6. The electrical connector as recited in claim 5, wherein projections are provided on the mating member receiving section proximate the free end, the projections bear against the arcuate cylindrical member of the mating member as the electrical connector is inserted on the mating member, whereby the projections secure the mating member receiving section to the mating member.

7. The electrical connector as recited in claim 6, wherein the mating member is resiliently deformable.

8. The electrical connector as recited in claim 1, wherein each latching member has at least one stabilization member, the stabilization member being spaced from a respective latching arm.

9. The electrical connector as recited in claim 8, wherein both ends of each of the stabilization members are fixed to the latching member, each of the stabilization members having a bearing surface to engage the mating member to prevent lateral movement of the electrical connector relative to the arcuate cylindrical member the mating member.

10. A mounting member for use with a connector, the mounting member comprising:

a latching member, a stabilization member and a mating member having a receiving section;

the mating member receiving section having an arcuate configuration which cooperates with a mating arcuate cylindrical member of a mating connector to maintain the connector on the arcuate cylindrical member;

the latching member having a latching arm, the latching arm having an arcuate configuration which cooperates with a surface of the mating member to prevent unwanted rotation of the connector relative to the mating member; and the stabilization member having an arcuate configuration which cooperates with the mating arcuate cylindrical member of the mating connector to prevent lateral movement of the connector relative to the arcuate cylindrical member.

11. The mounting member as recited in claim 10, wherein the latching arm has a fixed end which is attached to the latching member and a free end, the latching arm being resiliently deformed as the connector is inserted on to the mating member.

12. The mounting member as recited in claim 11, wherein the latching arm has a locking shoulder and an inclined surface, the locking shoulder is at the end of the inclined surface, the inclined surface is inclined from proximate the free end to the shoulder, the inclined surface is configured to resiliently bear against a wall of the mating member as the connector is rotated during mounting of the connector to the mating member.

13. The mounting member as recited in claim 12, wherein a stop surface extends from proximate the locking shoulder toward the fixed end, the stop surface cooperates with the wall of the mating member, whereby the cooperation of the locking shoulder and the stop surface with the wall of the mating member prevents unwanted rotation of the connector relative to the mating member.

14. The mounting member as recited in claim 10, wherein the mating member receiving section extends from the latching member, the mating member receiving section has a fixed end which is attached to the latching member and a free end.

15. The mounting member as recited in claim 14, wherein projections are provided on the mating member receiving section proximate the free end, the projections bear against the arcuate cylindrical member of the mating member as the connector is inserted on the mating member, whereby the projections secure the mating member receiving section to the mating member.

16. The mounting member as recited in claim 15, wherein the mating member is resiliently deformable.

17. The mounting member as recited in claim 10, wherein the stabilization member is spaced from the latching arm, the stabilization member having a bearing surface thereon, the bearing surface provided to engage the mating member to prevent lateral movement of the connector relative to the arcuate cylindrical member the mating member.

18. The mounting member as recited in claim 17, wherein both ends of each of the stabilization members are fixed to the latching member.

19. A method of inserting a connector on an arcuate cylindrical mating member, the method comprising:

moving the connector into position proximate the mating member;

resiliently deflecting a free end of a receiving section, allowing a projection of the receiving section to maintained the receiving section on the mating member;

rotating the connector on the mating member, causing a shoulder of a resilient latching arm to cooperate with a wall of the mating member;

continuing rotation of the connector until a stop surface of the latching arm is positioned proximate to or in engagement with the wall of the mating member, thereby allowing the latching arm to be returned toward its unstressed position, whereby the cooperation of the shoulder and the stop surface with the wall of the mating member prevent further unwanted rotation of the connector relative to the mating member.

20. The method of claim 19 comprising:

providing a stabilization member, the stabilization member engaging the mating member to prevent lateral movement of the connector relative to the mating member.

* * * * *